US008109114B2

(12) United States Patent
Lee et al.

(10) Patent No.: US 8,109,114 B2
(45) Date of Patent: Feb. 7, 2012

(54) ICE MAKER AND CONTROL METHOD OF SAME

(75) Inventors: Tae Hee Lee, Seoul (KR); Hong Hee Park, Seoul (KR); Joon Hwan Oh, Seoul (KR); Young Jin Kim, Seoul (KR); Kwang Ha Suh, Seoul (KR)

(73) Assignee: LG Electronics Inc., Seoul (KR)

( * ) Notice: Subject to any disclaimer, the term of this patent is extended or adjusted under 35 U.S.C. 154(b) by 379 days.

(21) Appl. No.: 12/142,172

(22) Filed: Jun. 19, 2008

(65) Prior Publication Data

US 2009/0019880 A1 Jan. 22, 2009

(30) Foreign Application Priority Data

Jul. 16, 2007 (KR) ..... 10-2007-0071153

(51) Int. Cl.
*F25C 1/00* (2006.01)
*F25C 1/22* (2006.01)

(52) U.S. Cl. ..... 62/353; 62/340

(58) Field of Classification Search ..... 62/351, 62/353, 340

See application file for complete search history.

(56) References Cited

U.S. PATENT DOCUMENTS 4,432,529 A * 2/1984 McMillan ..... 249/52

FOREIGN PATENT DOCUMENTS

| | | |
|---|---|---|
| JP | 5-296623 | 11/1993 |
| JP | 6-241626 | 9/1994 |
| JP | 6-273014 | 9/1994 |
| JP | 9-61023 | 3/1997 |
| KR | 10-1993-0013644 | 7/1993 |
| KR | 1996-008175 | 6/1996 |
| KR | 10-2007-0048166 | 5/2007 |
| KR | 1020070048166 | 5/2007 |
| WO | WO 2006/002224 | 1/2006 |

OTHER PUBLICATIONS

Machine Translation of JP06-273014.*
Machine Translation of JP05-296623.*
International Search Report and Written Opinion dated Nov. 9, 2009.
Korean Office Action dated Mar. 19, 2008.
Korean Office Action dated Sep. 3, 2008.

* cited by examiner

*Primary Examiner* — Frantz Jules
*Assistant Examiner* — Daniel C Comings
(74) *Attorney, Agent, or Firm* — KED & Associates, LLP

(57) ABSTRACT

An ice maker and a controlling method thereof are provided. The system and method may prevent the overflow or splashing of water or thin ice out of an ice tray during the supply of water or when the ice maker is shaken by an external force. The ice maker may include an ice tray, and an ice tray cover that covers an open portion of the ice tray. The cover may include an opening through which water may be supplied to the ice tray, and through which ice may be discharged from the ice tray. The cover may move together with the tray, or may move separately from the tray, to facilitate these supply and discharge processes.

12 Claims, 10 Drawing Sheets

ICE MAKER AND CONTROL METHOD OF SAME

BACKGROUND

This application claims the benefit of Korean Patent Application No. 10-2007-0071153, filed in Korea on Jul. 16, 2007, which is hereby incorporated by reference in its entirety as if fully set forth herein.

1. Field

This relates to an ice maker and a controlling method thereof, and more particularly, to an ice maker that is capable of preventing the overflow or splashing of water or thin ice out of an ice tray as water is supplied to the ice tray, or when the ice tray is shaken by an external force, and a controlling method of such an ice maker.

2. Background

Generally, an ice maker is provided in a freezing apparatus such as, for example, a refrigerator, a water purifier, a vending machine, and an ice making apparatus (hereinafter, referred to as "a refrigerator or the like"). In a simple ice making systems, a container containing water is placed in a freezing chamber and the water is frozen below the freezing point to produce ice. The container may be an ice tray having an interior divided into a plurality of spaces into which water may be supplied and frozen into ice. The ice may then be separated from the container manually, or in an automated manner. In a manual system, a user manually removes the ice from the freezing chamber.

Ice trays may be classified as a heating type ice tray or as a twist type ice tray based on how the ice is separated from the tray. In an automated heating type ice tray, a heater heats the ice tray such that the outer surface of the ice in the ice tray melts and separates from the ice tray. In a twist type ice tray, the ice tray is twisted, and the ice is separated from the ice tray without the use of a heater. An ice separating system and method which minimizes or eliminates the flow of water and/or partially frozen, thin pieces of ice, out of the tray is desirable.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to embodiments, examples of which are illustrated in the accompanying drawings. Wherever possible, the same reference numbers will be used throughout the drawings to refer to the same or like parts.

An ice separating system may include an ice tray made of a conductive material. A pulse may be applied to the ice tray for a short period of time to melt outer surfaces of the ice that are in contact with the ice tray to release a bond therebetween so that the ice may be separated form the ice tray. The relatively short heating period may minimize excess water generation during melting and may maintain the ice in a desired shape.

However, water or thin ice may splash out of or overflow from the ice tray during the supply of water into the ice tray or during the production of ice. More specifically, water may splash as it is supplied to the ice tray, or the ice maker in which the ice tray is mounted, may be shaken by an external force during the production of ice, and water or thin ice may overflow from the ice tray.

Consequently, the water may be introduced into an ice storage box and then re-frozen into ice. This causes ice pieces stored in the storage box to stick to each other, causing difficulty in removal and use. Also, water may infiltrate and be frozen in/on peripheral components adjacent to the ice maker, thus degrading the freezing efficiency of the ice maker and the overall reliability of the system.

Figure 1:
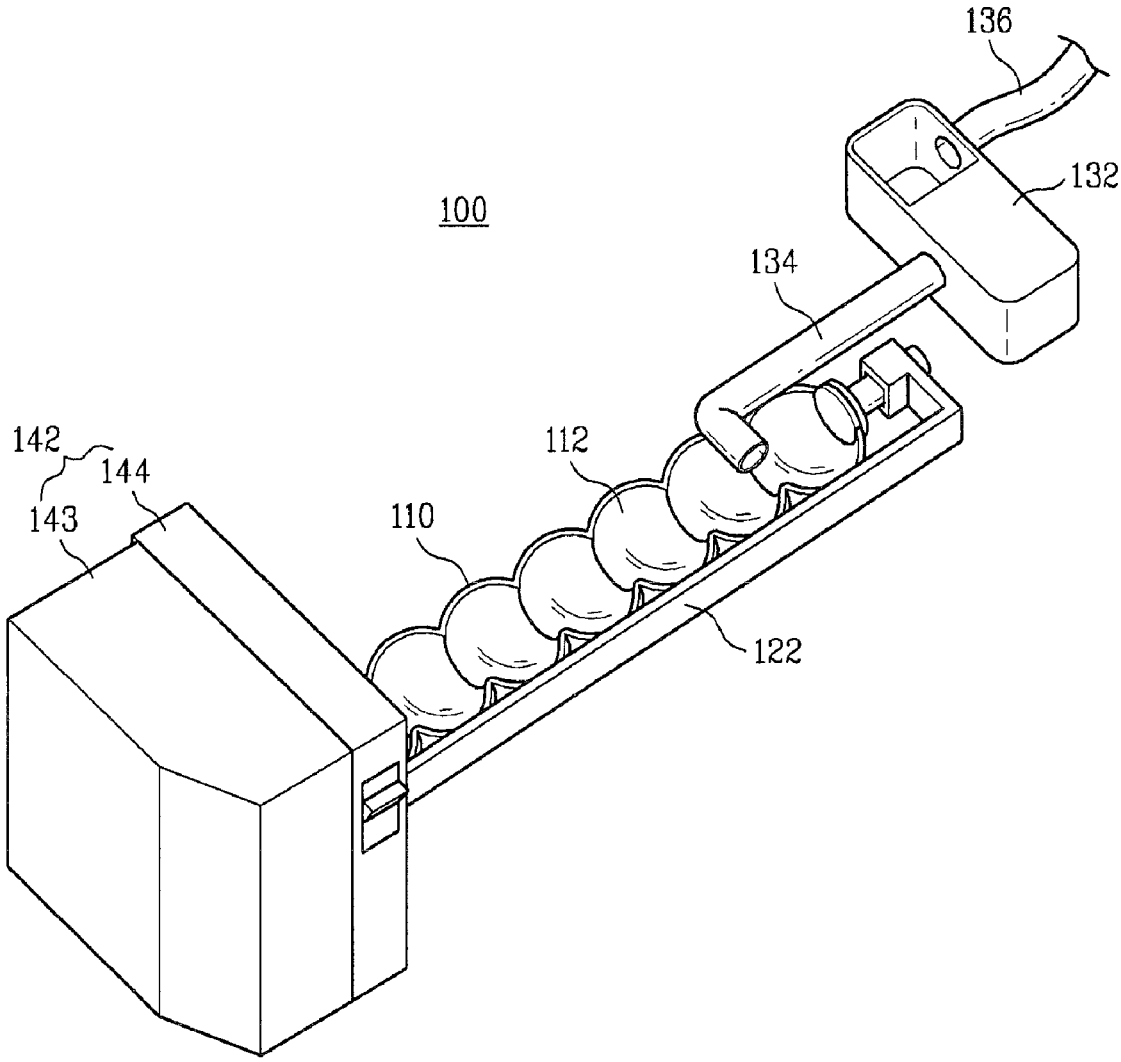
FIG. 1 is a perspective view of an ice maker according to an embodiment as broadly described herein.
Figure 2:
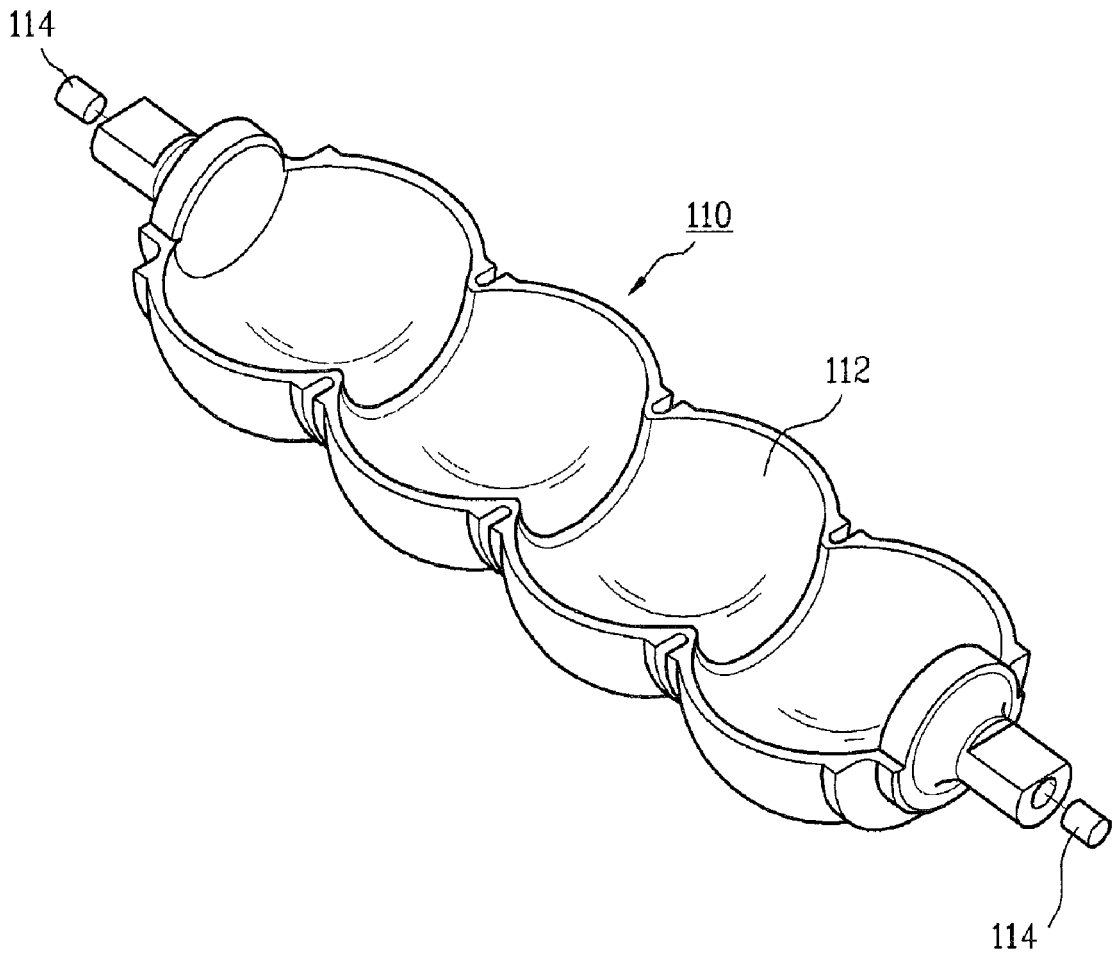
FIG. 2 is a perspective view of an ice tray of the ice maker shown in FIG. 1.
Figure 3:
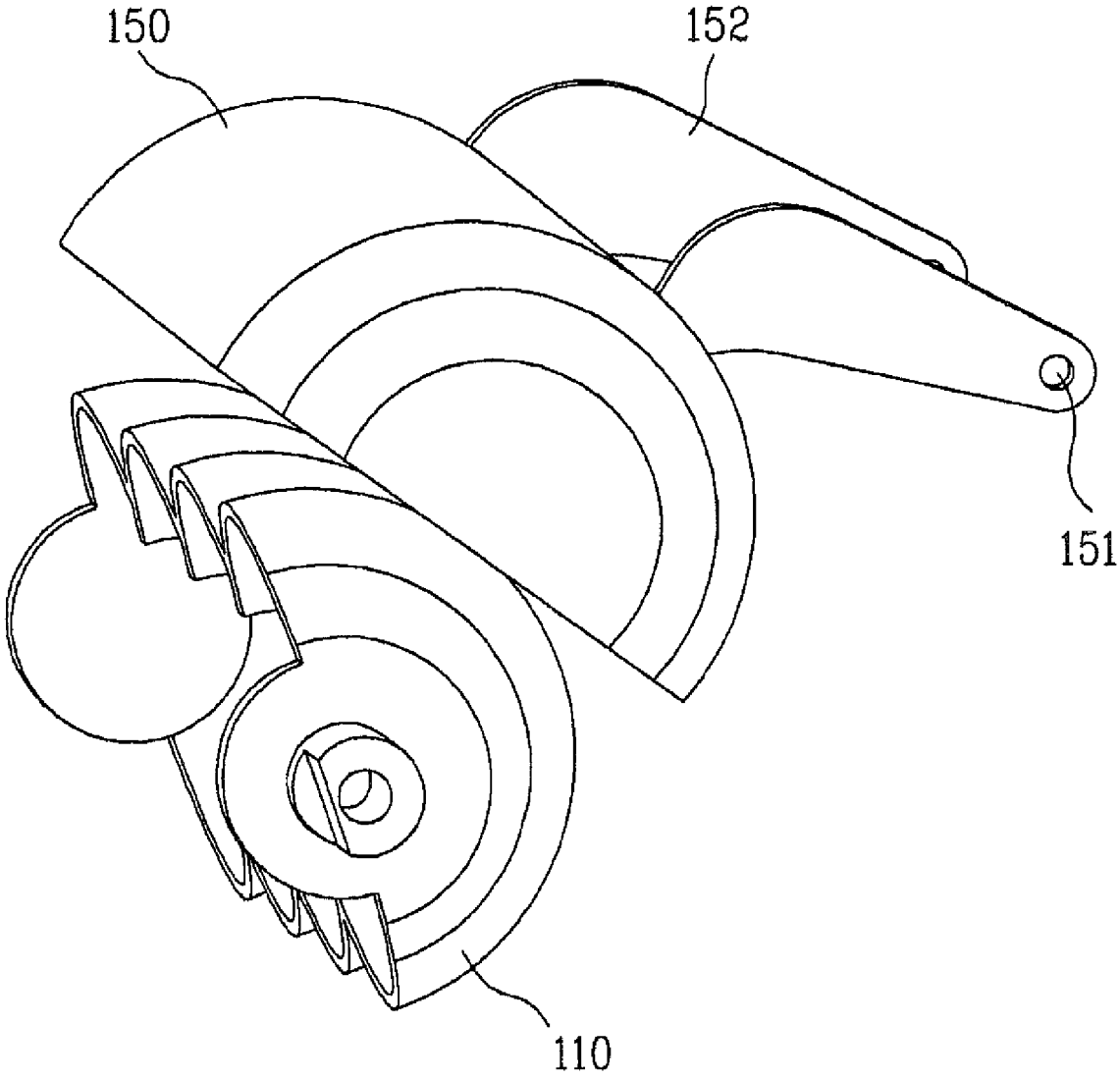
FIG. 3 is a perspective view of an ice maker according to an embodiment as broadly described herein.

As shown in FIGS. 1-3, an ice maker 100 according to embodiments as broadly described herein may include an ice tray 110 that receives water to be frozen into ice, and an ice tray cover 150 positioned above the ice tray 110 to prevent the overflow or splashing of water from the ice tray 110. Such an ice tray cover 150 may be used with a heating type ice tray or a twist type ice tray.

The ice tray 110 may include at least one receiving part 112 that receives water to produce ice. The top of the at least one receiving part 112 may include an opening through which water may be supplied to the ice tray, and through which the ice may be discharged from the ice tray.

As shown in FIGS. 1 and 2, ice tray 110 may include a plurality of receiving parts 112 arranged, for example, in a line. Alternatively, the ice tray 110 may include a plurality of receiving part lines, each of which includes a plurality of receiving parts 112 arranged in a line, the receiving part lines being arranged parallel to each other. The receiving parts 112 may be formed in various different shapes. For example, the receiving parts 112 may be formed in the shape of a hemisphere or a cube. The ice tray 110 may include receiving parts 112 formed in other shapes, including more complicated shapes, such as, for example, a star, a heart, or other shapes desired by a user.

The ice maker 100 may include a moving part that moves the ice tray 110 between an initial position and an ice separation position such that, after the water contained in the ice tray 110 is frozen into ice, the produced ice may be separated and discharged from the ice tray 110. The moving unit may linearly or rotatably move the ice tray 110. When the moving unit is constructed to rotate the ice tray 110, the moving unit may rotate the ice tray 110 about a central axis of the ice tray 110 that extends in a longitudinal direction of the ice tray 110 (in the direction in which the receiving parts 112 are arranged in a line) such that the open top of each receiving part 112 is directed upward when the ice tray 110 is in the initial position, and downward when the ice tray 110 is in the separation position.

The moving unit may include a rotary member 122 that is axially coupled to opposite ends of the ice tray 110, and a motor (not shown) provided at one side of the rotary member 112 for rotating the ice tray 110 as well as the rotary member 122. When ice production is completed, the motor may be driven to rotate the ice tray 110, which is coupled to the rotary member 122. Alternatively, the rotary member 122 may be fixed such that the motor rotates only the ice tray 110.

The ice tray 110 may have a rotation angle of 90 to 180 degrees. When the rotation angle of the ice tray 110 is within this range, the ice, after being separated from the ice tray 110, may fall into an ice storage bin (not shown) by virtue of its own weight, without further movement of the ice by an additional apparatus.

The ice maker 100 may also include a water supply unit that supplies water to the ice tray 110. The water supply unit may include a storage container 132 that receives and stores water, and a water supply pipe 134 that supplies water from the storage container 132 to the ice tray 110. In certain embodiments, the storage container 132 may be connected to a water supply hose 136 such that water may be supplied to the storage container 132 from an external source. An opening and closing unit (not shown) may be provided at the connection between the water supply pipe 134 and the storage container 132 to control the flow of water therebetween such that water is supplied to the ice tray 110 only when needed.

The ice maker 100 may also include a heating unit that heats the ice tray 110 so as to facilitate the separation of the ice from the ice tray 110. The heating unit partially or entirely melts the ice at an interface between the ice and the ice tray 110, thus releasing a bond between the ice and the ice tray 110 and allowing the ice to be separated and discharged from the ice tray 110.

The heating unit may include any kind of heater or heat generating member that can be intermittently turned on/off. In certain embodiments, the ice tray 110 may be made of a conductive material, and a pulse may be applied to the ice tray 110 such that the ice at the interface with the tray 110 may be melted, and the ice may be separated from the ice tray 110.

For this purpose, the heating unit may include a current supplier 142 that supplies current to the ice tray 110. The current supplier 142 may include a power supply 143 and an input controller 144. In certain embodiments, the heating unit may be constructed to include the ice tray 110 made of the conductive material.

In this instance, the ice tray 110 made of the conductive material allows current to flow therethrough. Thus, the ice tray 110 may be made of a material having a high electrical conductivity, such as, for example, copper (Cu), silver (Ag), aluminum (Al), a stainless steel alloy, an aluminum alloy, or other material as appropriate. When electrodes 114 are connected to the ice tray 110, and a pulse is applied to the ice tray 110 through the electrodes 114, the ice tray 110 may be uniformly heated in a short period of time.

As shown in FIG. 2, electrodes 114 may be fitted in the opposite ends of the ice tray 110, and an electric circuit (not shown) may be connected to the electrodes 114 such that current flows through the ice tray 110. In this case, the electric circuit, which is connected to the electrodes 114, may be provided in the rotary member 122, or other location as appropriate.

When a pulse is applied to the ice tray 110 for a predetermined period of time, and the ice tray 110 is heated, the ice may be melted at the interface between the receiving parts 112 of the ice tray 110 and the ice produced in the receiving parts 112. As a result of this melting, a bond between the ice and the receiving parts 112 may be released, and the ice may be separated and discharged from the receiving parts 112. At this point, the ice tray 110 has already been rotated downward, and therefore, the ice falls from the ice tray 110 and into a storage bin by virtue of its own weight.

The amount of heat generated through the ice tray 110 may be controlled by controlling the application of current supplied from the power supply 143 in the form of a pulse by the input controller 144. The input controller 144 may include, for example, a resistance circuit, a triac circuit, a coil circuit, or other type of circuit as appropriate.

As shown in FIGS. 3 to 7, an ice maker according to embodiments as broadly described herein may include an ice tray cover 150 positioned above the ice tray 110 to prevent the overflow or splashing of water from the ice tray 110. The ice tray cover 150 may close off the openings of the respective receiving parts 112 of the ice tray 110 to prevent the splashing or overflow of water or thin ice from the ice tray 110 when the ice tray 110 is shaken by an external force.

The ice tray cover 150 may be coupled by a hinge to one side of a main body (not shown) of the ice maker 100 to allow the ice tray cover 150 to rotate and cover or expose the ice tray 110 as necessary. The ice tray cover 150 may include at least one connection member 152 that extends between one side of the ice tray cover 150 and the main body of the ice maker 100. An end of the at least one connection member 152 may include a hinge 151 that rotatably couples the connection member 152 to the main body of the ice maker 100. In alternative embodiments, the at least one connection member 152 may be hinged to another component of the ice maker 100 as appropriate for the particular installation. The at least one connection member 152 may rotate about the hinge 151 in the forward or reverse direction by a drive motor (not shown), with the result that the ice tray cover 150 covers or exposes the openings in the ice tray 110.

Consequently, when water is supplied to the ice tray 110 or when the ice tray 110 is rotated such that ice is discharged from the ice tray 110, the ice tray cover 150 may be rotated about the hinge by the drive motor to expose the openings in the ice tray 110 so that the water supply or the ice discharge may be carried out. During ice production, after water has been supplied, the ice tray cover 150 may be rotated downward by the drive motor to cover the top of the ice tray 110.

Figure 4:
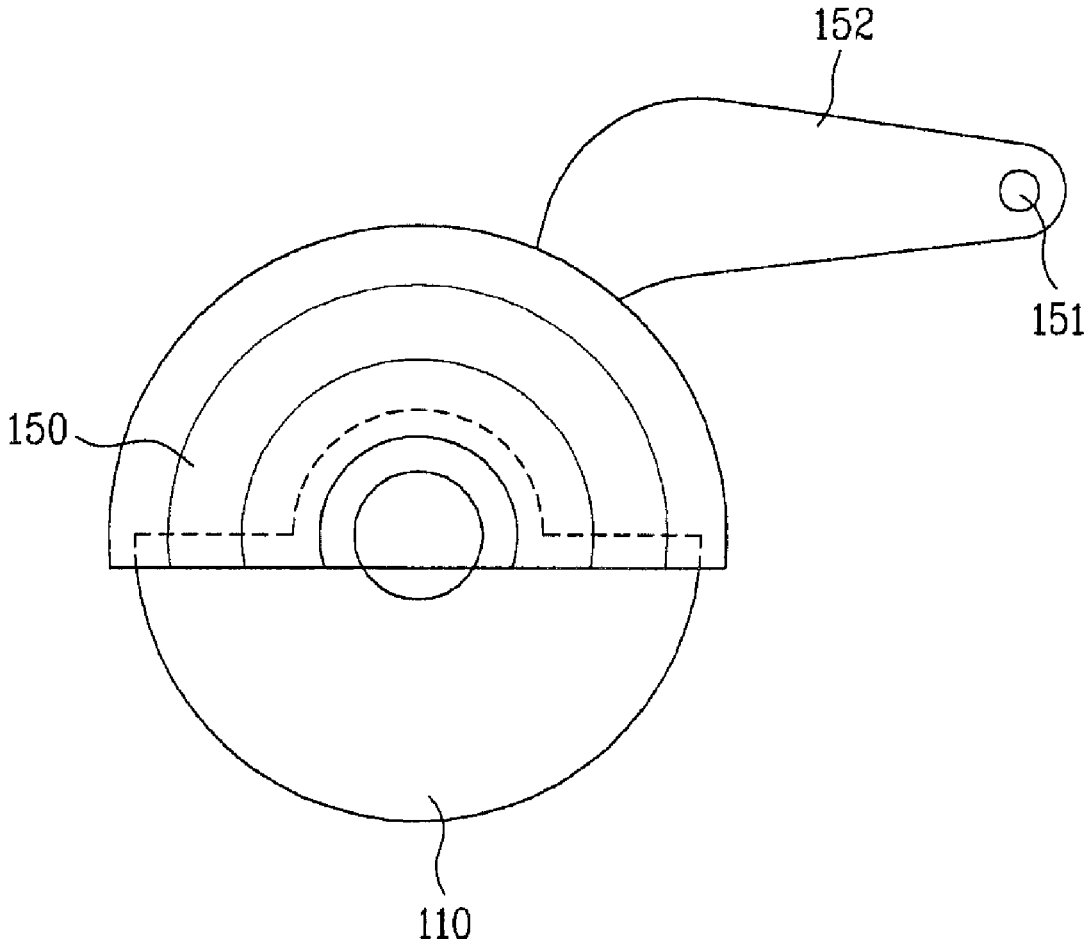
FIG. 4 is a perspective view of an ice tray and ice tray cover as embodied and broadly described herein.

In certain embodiments, the bottom of the ice tray cover 150 may be formed to correspond to the shape of the top of the ice tray 110, and the bottom of the ice tray cover 150 may thus form a seal over the receiving parts 112 of the ice tray 110, as shown in FIG. 4. The ice tray cover 150 may be made of a flexible material so that the ice tray cover 150 may be brought into tight contact with the ice tray 110 to cover and seal the ice tray 110, thereby preventing the leakage of water.

Figure 5:
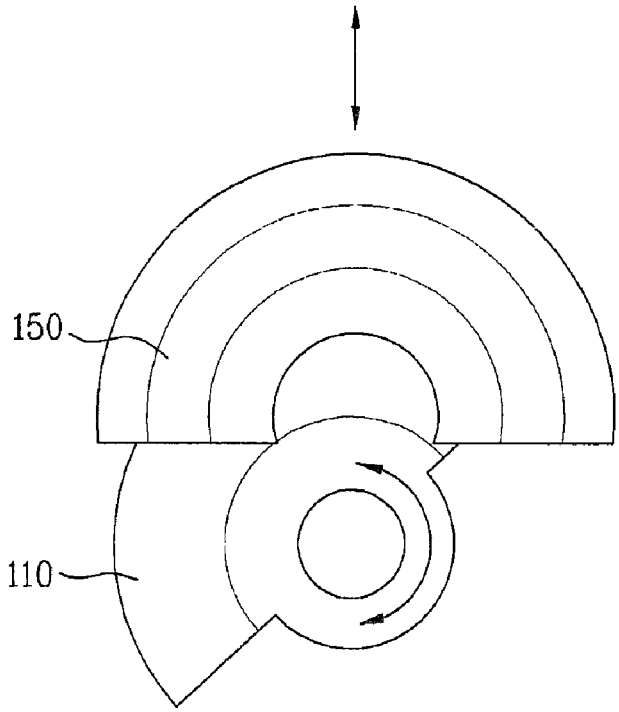
FIG. 5 is a side view of an ice maker according to an embodiment as broadly described herein.

In a structure that allows water to be supplied to the ice tray 110, while the ice tray cover 150 covers the ice tray 110, the ice tray cover 150 may be connected to a drive unit (not shown) and a moving member (not shown) such that the ice tray cover 150 can be linearly moved upward or downward to expose or cover the openings in the ice tray 110. Consequently, when water is supplied to the ice tray 110, or when the ice tray 110 is rotated so that ice may be discharged from the ice tray 110, the ice tray cover 150 may be moved so as to expose the ice tray 110, so that the water supply or the ice discharge may be carried out. After water has been applied to the ice tray 110, the ice tray cover 150 may be moved again to cover the top of the ice tray 110. In certain embodiments, the ice tray cover 150 may be moved linearly upwards to expose the ice tray 110, and linearly downward to again cover the ice tray 110, as shown in FIG. 5. Other movements may also be appropriate, based on a position of the cover 150 relative to the tray 110.

A lower peripheral edge or a bottom surface of the ice tray cover 150 may correspond to the shape of the top of the ice tray 110, so that the bottom of the ice tray cover 150 covers and seals the receiving parts 112 of the ice tray 110. The ice tray cover 150 may be made of a flexible material to allow the ice tray cover 150 to be brought into tight contact with the ice tray 110, thereby preventing the leakage of water.

Figure 6:
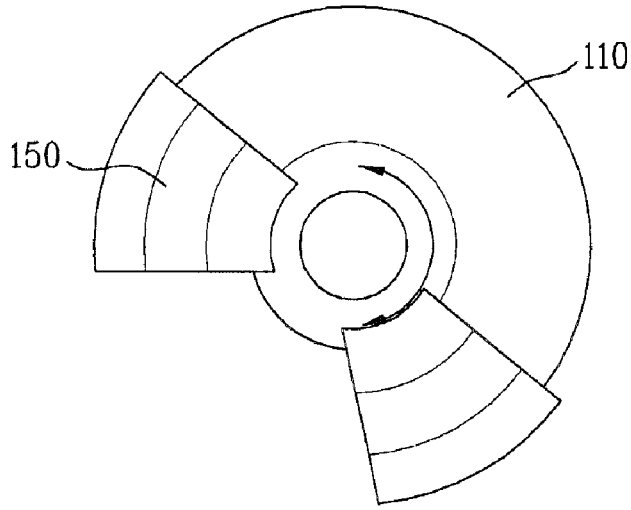
FIG. 6 is a side view of an ice maker according to an embodiment as broadly described herein.

In the embodiment shown in FIG. 6, the ice tray cover 150 may remain stationary relative to the ice tray 110, with the ice tray cover 150 integrally coupled to the ice tray 110. For example, the ice tray cover 150 may be molded together with the ice tray 110 by double injection, or may be integrally attached to the ice tray 110 by bonding or welding, depending upon the material of the ice tray cover 150 and the ice tray 110.

When the ice tray 110 is made of a conductive material to which a pulse is applied to separate the ice from the ice tray 110, the ice tray cover 150 may be made of a nonconductive material. Consequently, when a pulse is applied to the ice tray 110, the introduction of current to the ice tray cover 150 is prevented, thereby providing for uniform heat generation and dispersion only in the receiving parts 112 of the ice tray 110, in which the ice is received, while reducing the power consumption. In this case, the ice tray cover 150 may be made of a high heat-resistant material such that the ice tray cover 150 is not deformed or damaged, even when the ice tray 110 is heated.

Figure 7:
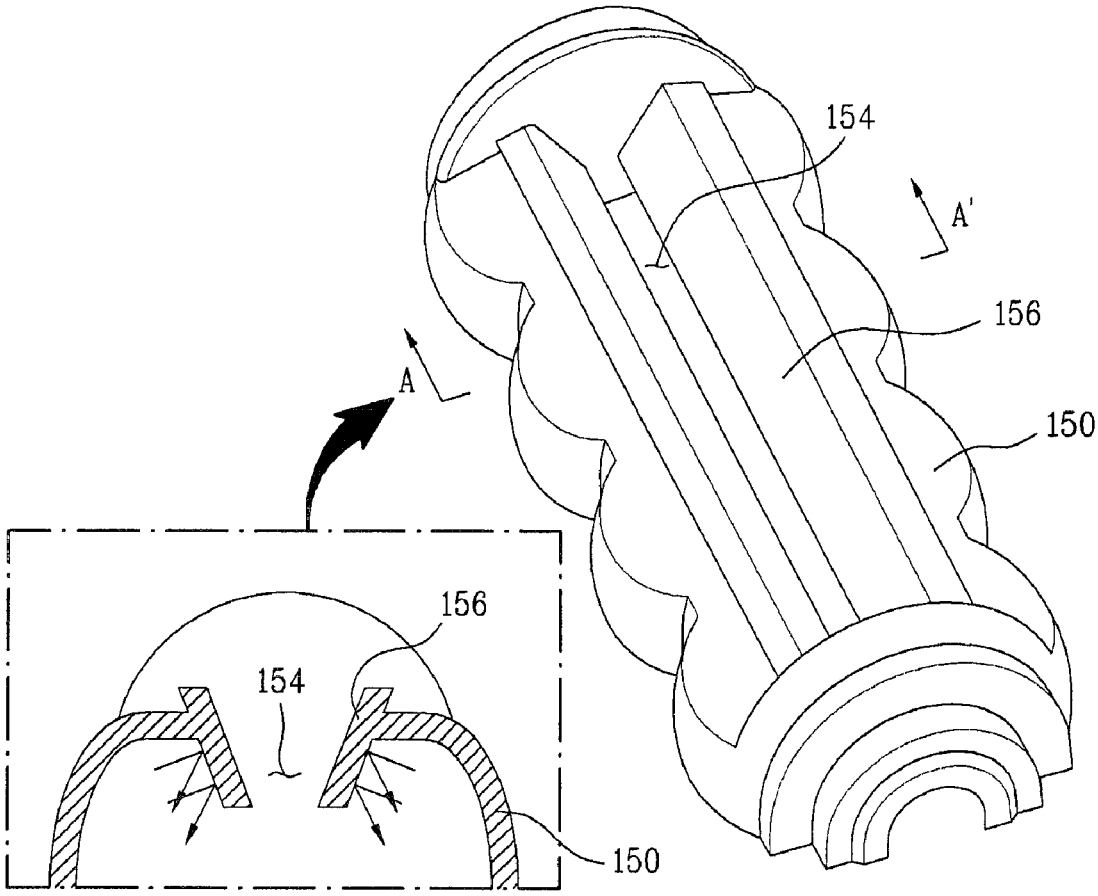
FIG. 7 is a top perspective view of the ice tray cover shown in FIG. 6.
Figure 8A:
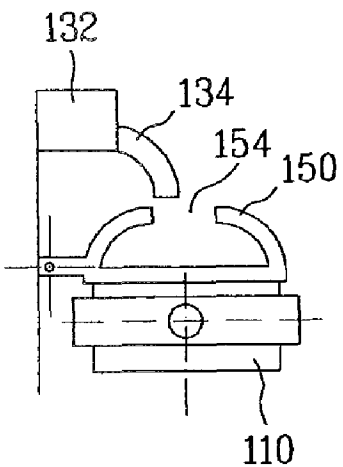
FIGS. 8A-8E illustrate a sequence in an operation process of the ice maker shown in FIG. 3.
Figure 8B:
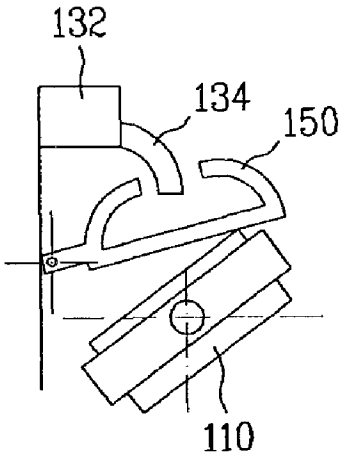
Figure 8C:
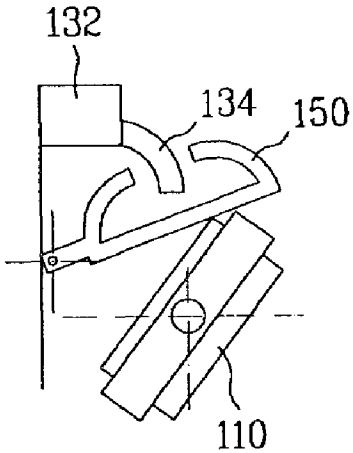
Figure 8D:
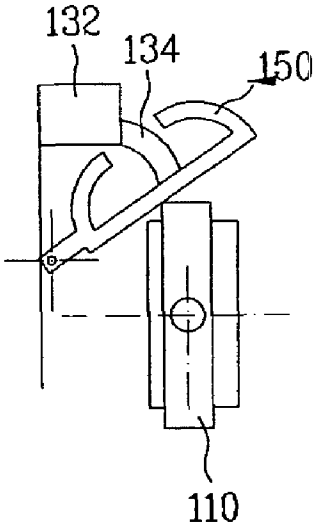
Figure 8E:
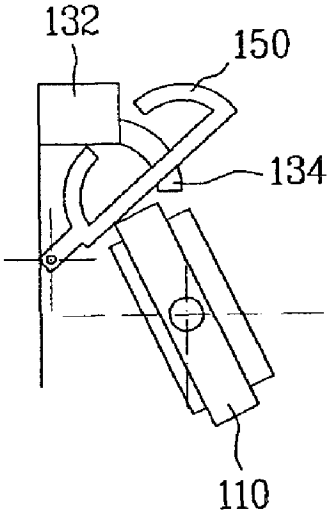
Figures 9A, 9B, 9C, 9D:
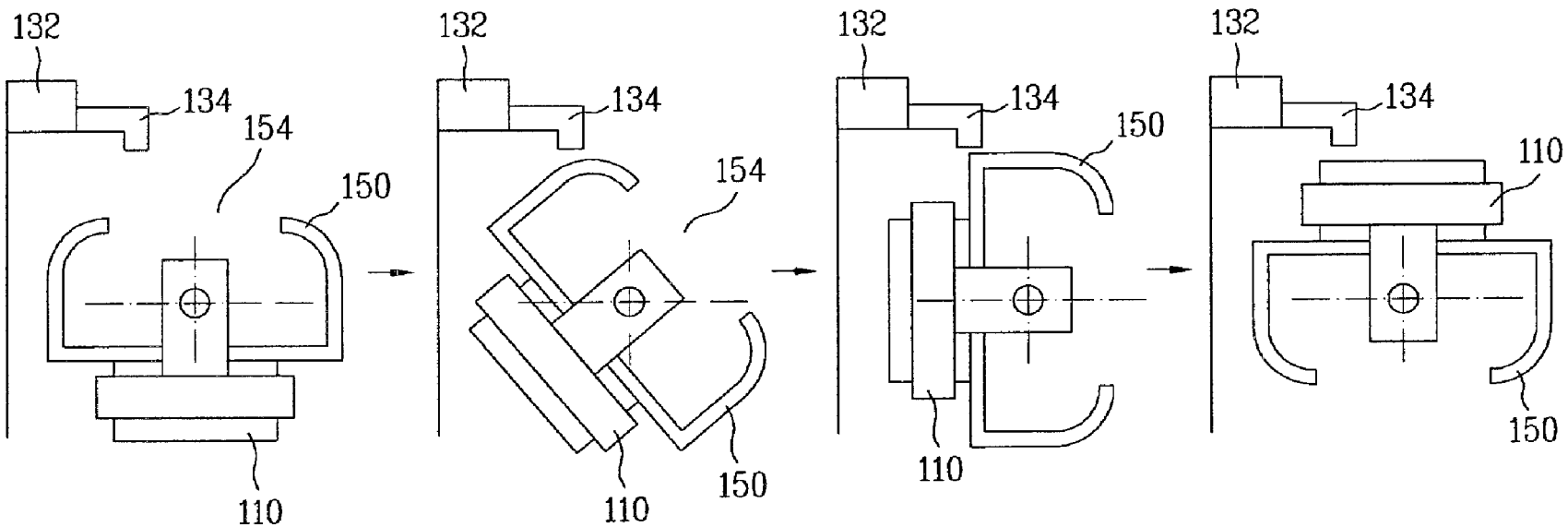
FIGS. 9A-9D illustrate a sequence in an operation process of the ice maker shown in FIG. 5.
Figures 10A, 10B, 10C, 10D, 10E:
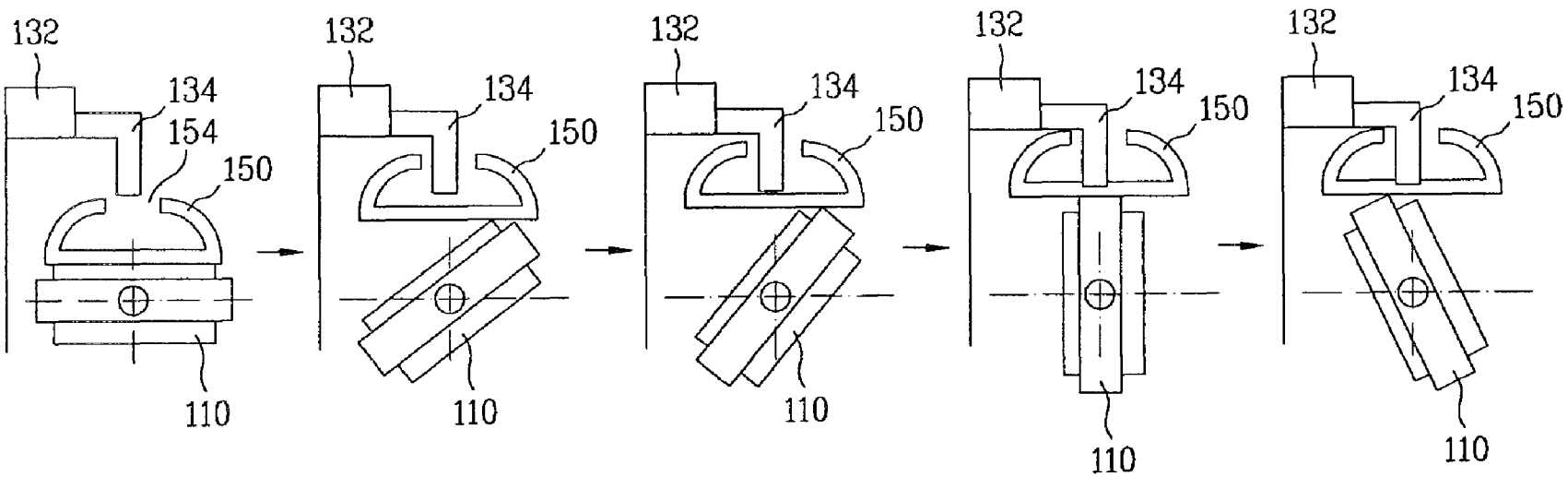
FIGS. 10A-10E illustrate a sequence in an operation process of the ice maker shown in FIG. 6.
Figure 11:
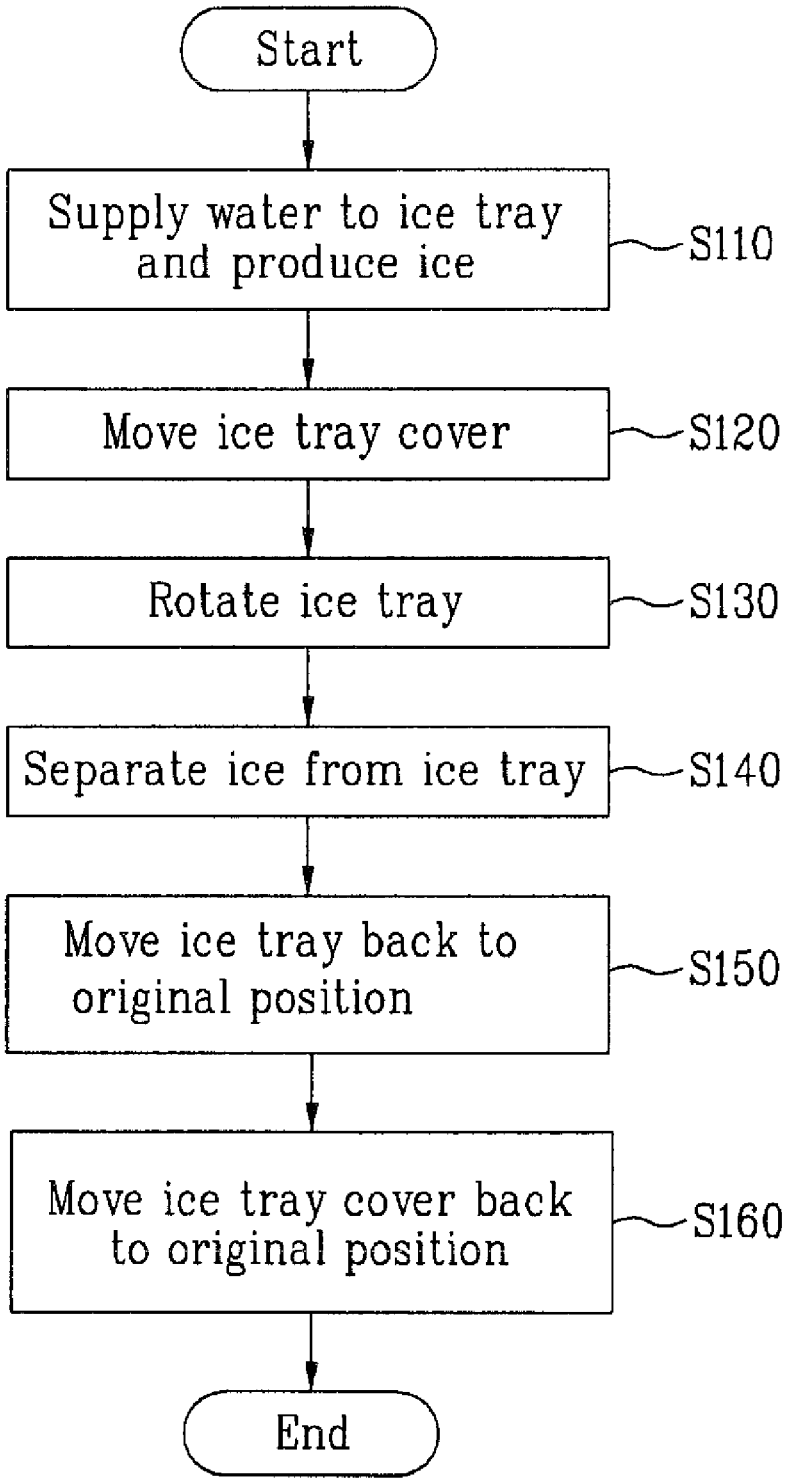
FIG. 11 is a flow chart of a controlling method of an ice maker according to an embodiment as broadly described herein.

The ice tray cover 150 shown in FIG. 6 may include a communication part 154 formed at the top of the ice tray cover 150 that allows water to be supplied to the ice tray 110, as shown in FIG. 7. In the alternative embodiments, the communication part 154 may also be formed in an ice tray cover 150 that is rotated about a hinge, as shown in FIG. 3, or in an ice tray cover 150 that is moved upward and downward, as shown in FIG. 5, such that water may be supplied to the ice tray 110 without the movement of the ice tray cover 150.

The communication part 154 may extend in the longitudinal direction of the ice tray cover 150 (i.e., in the longitudinal direction of the ice tray 110) to provide a channel for supplying water to the ice tray 110. The communication part 154 may also serve as a channel for supplying cool air necessary to freeze water received in the receiving parts 112 of the ice tray 110 during the production of ice.

The ice tray cover 150 may also include waterproofing walls 156 extending downward from opposite edges of the communication part 154 to prevent the splashing of water through the communication part 154. As shown in the sectional view taken along line A-A' of FIG. 7, the waterproofing walls 156 may be inclined toward the center line of the communication part 154 so as to further preclude the splashing water out of the ice tray 110. In the embodiments shown in FIGS. 3 and 5, the ice tray cover 150 is rotated or moved to expose the ice tray 110 to discharge ice from the ice tray 110. Consequently, the waterproofing walls 156 shown in FIG. 7 may be sized and inclined so that they do not disturb the discharge of the ice from the ice tray 110.

When the ice tray cover 150 is integrally coupled to the ice tray 110, as shown in FIG. 6, the ice tray 110 and the ice tray cover 150 may be simultaneously rotated to separate the ice from the ice tray 110. Depending on the size/shape of the ice produced, the size of the communication part 154 and the inclination of the waterproofing walls 156, the waterproofing walls 156 may disturb the discharge of the ice from the ice tray 110. Thus, in certain embodiments, the waterproofing walls 156 may be removed, and the communication part 154 may have a size sufficient for the ice to easily pass through the communication part 154 without the ice being caught by the communication part 154.

A control method for an ice maker according to embodiments as broadly described herein will now be described with respect to FIGS. 8-11.

Such a controlling method may include supplying water to the ice tray 110 through the communication part 154, formed at the ice tray cover 150, and freezing the water into ice (S110), rotating the ice tray 110 such that the ice may be separated from the ice tray 110 and fail by virtue of its own weight into a storage bin (S130), heating the ice tray 110 to release a bond between the ice and the ice tray 110 and separate the ice from the ice tray 110 (S140), and then rotating the ice tray 110 back to its original position (S150).

To supply water to the ice tray 110, a control unit (not shown), for controlling the overall function and operation of the ice maker 100, controls the water supply unit such that water stored in the storage container 132 is supplied to the ice tray 110 through the water supply pipe 134. The water may be supplied to the ice tray 110 through the communication part 154 formed at the ice tray cover 150. After the supply of water is completed, cool air may be supplied to the ice tray 110 to freeze the water and produce ice (S110).

After the production of ice is completed, the ice tray cover 150 may be moved such that the ice tray 110 is exposed (S120). The ice tray 110 may then be rotated such that the ice falls by virtue of its own weight into a storage bin (S130).

In certain embodiments, the ice tray 110 may be rotated after the movement of the ice tray cover 150. In alternative embodiments, the two steps (S120 and S130) may be simultaneously carried out. That is, the ice tray 110 may be rotated to the ice separation position (S130) simultaneously with the movement of the ice tray cover 150 (S120).

In the embodiment shown in FIG. 3, the ice tray cover 150 is hingedly coupled to the main body of the ice maker 100, and the ice tray cover 150 is rotated about the hinge. Operation of this embodiment of the ice tray cover 150 and the ice tray 110 is shown in FIGS. 8A-8E.

In the embodiment shown in FIG. 5, the ice tray cover 150 is moved upward and downward. Operation of this embodiment of the ice tray cover 150 and the ice tray 110 is shown in FIGS. 10A-10D.

In the embodiment shown in FIGS. 6-7, the ice tray cover 150 may be integrally coupled to the ice tray 110. In this embodiment, the ice tray cover 150 and the ice tray 110 are simultaneously rotated to the ice separation position, as shown in FIGS. 9A-9D.

After the ice tray 110 is moved to the ice separation position, the ice tray 110 may be heated to separate the ice from the ice tray 110 and discharge the ice from the ice tray 110 to a storage bin. As previously described, the ice tray 110 may be made of a conductive material exhibiting electrical conductivity, and a pulse may be applied to the ice tray 110 to heat the ice tray 110. In alternative embodiments, a twist type ice separating system may be used.

After the ice separation is completed, the ice tray 110 may be rotated back to its original position (S150). Also, the ice tray cover 150 is moved back to its original position to cover the ice tray 110.

In certain embodiments, the ice tray 110 and the ice tray cover 150 may be simultaneously moved back to their original positions. In this case, the operations of the ice tray 110 and the ice tray cover 150 according to the respective embodiments may be performed in reverse order that which is shown in FIGS. 8-10.

An ice tray cover 150 as embodied and broadly described herein may effectively prevent the overflow or splashing of water out of the ice tray 110 during the supply of water or when the ice tray 110 is shaken by an external force during the production of ice.

Reducing or eliminating this splashing/overflow of water may prevent ice pieces from sticking to each other and a subsequent lowering of freezing efficiency of the ice maker, thus enhancing overall reliability of the system and improving user convenience.

An ice maker is provided that is capable of preventing the overflow or splashing of water or thin ice to the outside during the supply of water or when the ice tray is shaken by an external force, and a controlling method of the same.

An ice maker as embodied and broadly described herein may include an ice tray for receiving water to be frozen into ice, and an ice tray cover positioned above the ice tray for preventing the overflow or splashing of water from the ice tray.

The ice tray may be rotatably mounted such that ice, separated from the ice tray, falls by virtue of its own weight.

The ice tray cover may be hingedly coupled to one side of a main body of the ice maker such that the ice tray cover can rotate about the hinge to cover or expose the ice tray. In this case, the ice tray cover may also include at least one connection member extending from one side of the ice tray cover, and the tip end of the at least one connection member may be hingedly coupled to the main body of the ice maker.

The ice tray cover may move upward or downward to expose or cover the ice tray.

The ice tray cover may be stationary, or the ice tray cover may be integrally coupled to the ice tray.

The ice maker may also include a communication part formed at the top of the ice tray cover for allowing water to be supplied to the ice tray therethrough, and waterproofing walls extending downward from opposite edges of the communication part for preventing the splashing of water through the communication part. In this case, the waterproofing walls are preferably inclined toward the middle line of the communication part.

A controlling method of an ice maker as embodied and broadly described herein may include supplying water to an ice tray through a communication part, formed at an ice tray cover, and freezing the water into ice, rotating the ice tray such that the ice, separated from the ice tray, falls by virtue of its own weight, heating the ice tray to separate the ice from the ice tray, and rotating the ice tray, from which the ice has been separated, back to its original position.

The controlling method may also include moving the ice tray cover to expose the ice tray, in which the ice production is completed, and moving the ice tray cover back to its original position to cover the ice tray, from which the ice has been separated.

The ice tray cover may be hingedly coupled to a main body of the ice maker such that the ice tray cover can rotate about the hinge.

The ice tray cover may move upward and downward.

The ice tray may exhibit electric conductivity, and the heating of the ice tray may be accomplished by applying a pulse to the ice tray.

Any reference in this specification to "one embodiment," "an embodiment," "example embodiment," "certain embodiment," "alternative embodiment," etc., means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An ice maker, comprising:

an ice tray that receives water to be frozen into ice;

a supply pipe that supplies water to the ice tray; and a cover movably coupled to the ice tray so as to open and close an open upper portion of the ice tray and prevent discharge of water from the ice tray, wherein the cover includes:

a hole extending along a longitudinal center portion of the cover; and a pair of waterproofing walls that respectively extend along opposite longitudinal sides of the hole, wherein each of the pair of waterproofing walls extends at an incline from a respective upper edge thereof toward a central point between the pair of waterproofing walls, with the upper edge of each of the pair of waterproofing walls extending upward and outward beyond an adjacent exterior surface of the cover, and a lower edge of each of the pair of waterproofing walls extending downward and inward beyond an adjacent interior surface of the cover such that a distance between the respective upper edges of the pair of waterproofing walls is greater than a distance between the respective lower edges of the pair of waterproofing walls so as to guide water from the supply pipe into the ice tray.

2. The ice maker of claim 1, wherein the ice tray rotates between an upright position in which the tray receives water through the open upper portion thereof and a separation position in which the open upper portion of the ice tray is oriented downward such that ice is discharged from the ice tray by virtue of its own weight.

3. The ice maker of claim 2, wherein the cover is rotatably coupled to a main body of the ice maker such that the cover rotates relative to the ice tray so as to cover or expose the open upper portion of the ice tray.

4. The ice maker of claim 3, further comprising:

at least one connection member that extends between the ice tray cover and the main body of the ice maker; and a hinge that rotatably couples a first end of the at least one connection member to the main body of the ice maker.

5. The ice maker of claim 2, wherein the cover moves upward to expose the open upper portion of the ice tray, and downward to cover the open upper portion of the ice tray.

6. The ice maker of claim 2, wherein the cover prevents discharge of water and thin ice from the ice tray when the ice tray is in the upright position, and provides for the discharge of ice from the ice tray when the ice tray is in the separation position.

7. The ice maker of claim 1, wherein a shape of a portion of the cover that is coupled to the open top portion of the ice tray corresponds to a shape of the open top portion of the ice tray, and wherein the cover is made of a flexible material so as to form a seal between the ice tray and the cover.

8. The ice maker of claim 1, wherein the cover has a plurality of different positions relative to the ice tray, between a fully closed position in which a lower portion of the cover confronts the open upper portion of the ice tray and a fully open position in which the lower portion of the cover and the open upper portion of the ice tray are separated by a maximum distance.

9. The ice maker of claim 8, wherein a discharge end of the supply pipe is positioned at an exterior side of the cover and aligned with the hole in the cover when the cover is in the fully closed position, and the supply pipe extends through the hole with the discharge end positioned at an interior side of the cover when the cover is in the fully open position.

10. The ice maker of claim 8, wherein the cover rotates between the fully closed position and the fully open position.

11. The ice maker of claim 8, wherein the cover is vertically raised and lowered between the fully closed position and the fully open position.

12. The ice maker of claim 1, wherein the pair of waterproofing walls define a substantially funnel shaped cross section that receives the supply pipe therein such that the supply pipe remains stationary as the cover moves relative to the ice tray.

* * * * *